US011988204B2

(12) United States Patent
Chretien et al.

(10) Patent No.: US 11,988,204 B2
(45) Date of Patent: May 21, 2024

(54) WELLSITE PUMPING SYSTEMS AND METHODS OF OPERATION

(71) Applicant: Halliburton Energy Services, Inc., Houston, TX (US)

(72) Inventors: Alexander S. Chretien, Duncan, OK (US); Stanley V. Stephenson, Duncan, OK (US); Mark A. Adams, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 649 days.

(21) Appl. No.: 17/262,110

(22) PCT Filed: Dec. 20, 2018

(86) PCT No.: PCT/US2018/066944
§ 371 (c)(1),
(2) Date: Jan. 21, 2021

(87) PCT Pub. No.: WO2020/131085
PCT Pub. Date: Jun. 25, 2020

(65) Prior Publication Data

US 2021/0301815 A1 Sep. 30, 2021

(51) Int. Cl.
*E21B 43/26* (2006.01)
*F04B 49/06* (2006.01)
*F04B 51/00* (2006.01)

(52) U.S. Cl.
CPC ..... *F04B 51/00* (2013.01); *F04B 49/06* (2013.01); *E21B 43/2607* (2020.05); *F04B 2203/0209* (2013.01)

(58) Field of Classification Search
CPC . E21B 47/008; F04B 49/06; F04B 2203/0209
See application file for complete search history.

(56) References Cited

U.S. PATENT DOCUMENTS 4,671,397 A 6/1987 Asagi
5,049,046 A 9/1991 Escue
(Continued)

FOREIGN PATENT DOCUMENTS

WO 2010021850 A1 2/2010
WO 2015179775 A1 11/2015

*Primary Examiner* — Cathleen R Hutchins
(74) *Attorney, Agent, or Firm* — K&L Gates LLP

(57) ABSTRACT

A pumping system for performing a borehole operation including pumping a fluid into a borehole. The system may include a motor, a transmission, a pump, and a control system. The motor, transmission, and pump may each include sensors. The transmission may be operatively coupled to the motor. The pump may be operatively coupled to the transmission and configured to pump fluid into the borehole. The control system may be in communication with the motor sensors, the transmission sensors, and the pump sensors. The control system may be configured to monitor the operation of the motor, the transmission, and the pump, determine if at least one of the motor, the transmission, or the pump is operating outside of predetermined parameters, and determine at least one component of the motor, the transmission, or the pump that is most likely to cause the operation to be outside of the predetermined parameters.

18 Claims, 4 Drawing Sheets

(56) References Cited

U.S. PATENT DOCUMENTS

| | | | | |
|---|---|---|---|---|
| 6,041,856 | A | 3/2000 | Thrasher | |
| 6,440,040 | B1 | 8/2002 | Amano | |
| 6,966,862 | B2 | 11/2005 | Inuta | |
| 7,402,123 | B2 | 7/2008 | Kobayashi | |
| 2007/0017672 | A1* | 1/2007 | Kayadarma | E21B 47/008 166/250.01 |
| 2007/0049457 | A1 | 3/2007 | Sato | |
| 2007/0066445 | A1 | 3/2007 | Kobayashi | |
| 2010/0175925 | A1 | 7/2010 | Ciglenec | |
| 2015/0204322 | A1* | 7/2015 | Iund | F04D 15/0094 175/48 |

* cited by examiner

WELLSITE PUMPING SYSTEMS AND METHODS OF OPERATION

BACKGROUND

This section is intended to provide relevant background information to facilitate a better understanding of the various aspects of the described embodiments. Accordingly, it should be understood that these statements are to be read in this light and not as admissions of prior art.

Pumping systems, which typically include a motor, a transmission, and a pump, are used in all phases of well servicing operations, for example, pumping systems may be used to pump water, cement, fracturing fluids, and other stimulation or servicing fluids as well as other pumping operations. During a well service operation, a portion of the pumping system may be compromised, filters may become plugged, or other conditions may occur that typically necessitate intervention by an operator. Currently, the operator must manually address any such conditions. However, the operator typically does not have a clear indication of what actions can be taken to mitigate the condition to allow the pumping system to continue operation, even if a reduced rate must be used.

Accordingly, there exists a need for an improved pumping system and method for operating a pumping system.

BRIEF DESCRIPTION OF THE DRAWINGS

Embodiments of the pumping system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides a pumping system for a wellsite. The pumping system allows the operator to quickly identify any adverse conditions that occur during the operation of the pumping system and adjust the pumping system to mitigate the adverse conditions.

Figure 1:
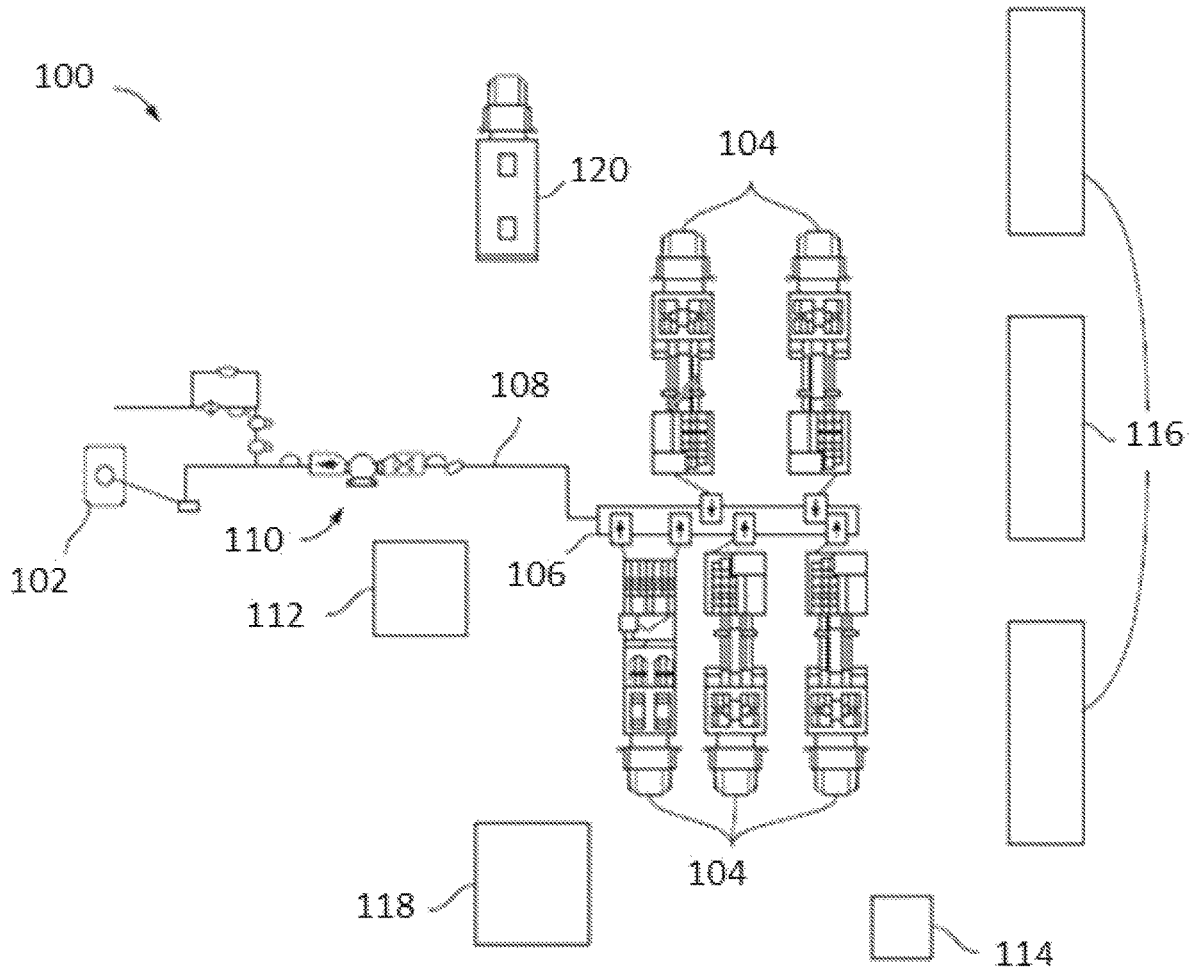
FIG. 1 is a schematic diagram of a wellsite, according to one or more embodiments.

FIG. 1 is a schematic diagram of a wellsite 100, according to one or more embodiments. The wellhead 102 is connected to one or more pieces of wellsite equipment, such as pumping systems 104 (five shown). The pumping systems 104 are connected to a manifold 106 and piping 108 that includes equipment, such as valves 110, for monitoring and/or controlling the flow of fluid into a borehole through the wellhead 102 positioned above the borehole. The wellsite 100 also includes pieces of equipment such a generator 112, a blender 114, storage tanks 116 (three shown), a fluid distribution system 118, and a monitoring and control unit 120. The storage tanks 116 may contain fuel, wellbore fluids, proppants, diesel exhaust fluid, and other materials.

The fluid distribution system 118 is fluidly coupled to one or more pieces of wellsite equipment, such as the pump trucks 104, the generator 112, the blender 114, or the monitoring and control unit 120. The fluid distribution system 118 supplies fluids, such as fuel, diesel exhaust fluid, fracturing fluid, or other chemicals, to the pieces of wellsite equipment 104, 112, 114 from one or more of the storage tanks 116. As shown in FIG. 1, much of the wellsite equipment is mounted on trucks. However, the wellsite equipment may also be free standing, mounted on a skid, or mounted on a trailer. Additionally, wellsite equipment that is shown as free standing may be mounted on a truck, a skid, or a trailer.

Figure 2:
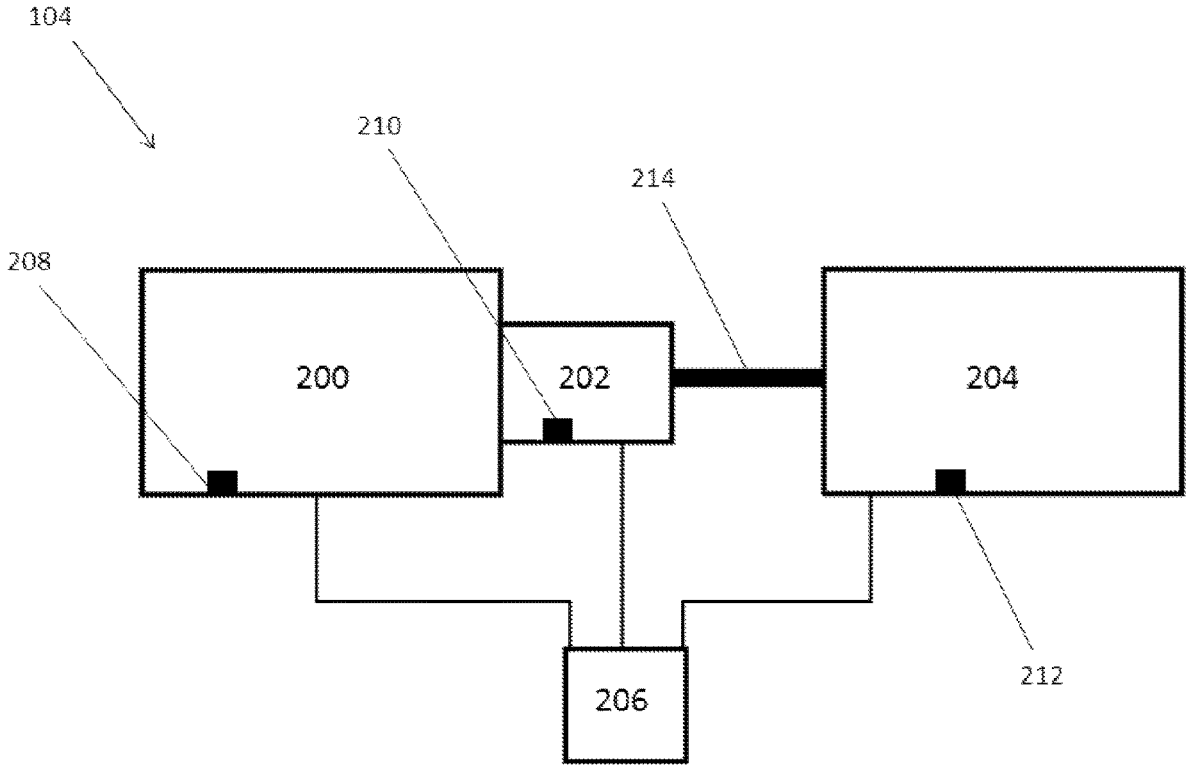
FIG. 2 is a schematic diagram of a pumping system of FIG. 1.

FIG. 2 is a schematic diagram of a pumping system 104 of FIG. 1. The pumping system 104 includes a motor 200, a transmission, 202, a pump 204, and a control system 206 that monitors sensors 208, 210, 212 positioned within the motor 200, transmission 202, and pump 204 as well as controls the operation of the motor 200, transmission 202, and pump 204. In other embodiments, the control system 206 may be omitted and the monitoring and control unit 120 may control the pumping system 104 as described below. As shown in FIG. 2, the transmission 202 is directly coupled to the motor 200 and the pump 204 may be coupled to the transmission 202 through a driveshaft 214. In other embodiments, the pump 206 may be directly coupled to the transmission 202, the motor 200 may be coupled to the transmission 202 through a driveshaft, or the transmission 202 may be omitted and the pump 204 may be coupled to the motor 200 directly or through a driveshaft.

The motor 200 may be an electric motor, a gasoline motor, a diesel motor, or another type of motor suitable for transferring torque to a pump 204 either directly or through a transmission 202. The motor also includes one or more sensors 208 that monitor various elements, conditions, or performance properties of the motor. As a non-limiting example, the motor sensor 208 or sensors may monitor a torque produced by the motor 200, a rotational speed of the motor 200, a temperature of the motor 200, and conditions of cylinders (not shown) within the motor 200. The motor sensor 208 or sensors may also monitor the status of filters (not shown), such as air filters and/or oil filters, within the motor 200 and the levels of various fluids, such as oil, water, fuel, and/or coolant, used by or within the motor 200.

The transmission 202 is an automatic transmission that includes multiple gears (not shown), clutches (not shown), solenoids (not shown), and a torque converter (not shown). The transmission 202 also includes a transmission sensor 210 or sensors that monitor various elements, conditions, or performance properties of the transmission 202. As a non-limiting example, the transmission sensor 210 monitors one or more of a torque transferred to the transmission 202 from the motor 200, a current gear that is being utilized by the transmission 202, or a temperature of the transmission 202. The sensors may also monitor the levels of oil and any other lubricants used in the transmission 202, as well as monitoring for transmission slippage, which occurs when the clutches slip without direction from the control system 206 or operator, or transmission sticking, which occurs when components of the transmission, such as clutches and solenoids, are stuck in the activated position and limits the available gears of the transmission.

The pump 204 is a reciprocating positive displacement pump that includes multiple plungers (not shown), cylinders (not shown), and pump chambers (not shown). The plungers reciprocate within the respective cylinders to compress or expand the volume of the respective pump chambers, moving fluid through the pump 204. The pump 204 also includes one or more valves (not shown) that open an inlet or inlets of the pump to allow fluid into the cylinder on a suction stroke of the respective plunger and one or more valves (not shown) that open an outlet or outlets to allow fluid out of the cylinder on a discharge stroke of the respective plunger. A sealing member (not shown) may be included between the cylinder and the plunger to prevent fluid from leaking outside of the cylinder and into the environment. The pump 204 also includes a pump sensor 212 or sensors that monitor various elements, conditions, or performance properties of the pump 204. As a non-limiting example, the pump sensor 212 monitors a torque transferred to the pump 204 from the transmission 202, a suction pressure of the pump 204, vibration of the pump 204, a temperature of the pump 204, and/or fluid flow rate out of the pump 204. The sensors may also monitor a discharge pressure of the pump 204, a rotational speed of the pump 204, a surface strain on the pump 204, or the position of the plungers within the respective cylinders.

As previously mentioned, the motor 200, the transmission 202, and the pump 206 are each electronically connected to the control system 206. Although a wired connection is shown in FIG. 2, the pumping system is not thereby limited. In other embodiments, one or more of the motor 200, transmission 202, and the pump 204 may be wirelessly connected to the control system 206 instead of utilizing a wired connection. In at least one embodiment, the control system 206 may be combined into the monitoring and control unit 120, which would be electronically connected to the motor 200, the transmission 202, and the pump 204. In such embodiments, the monitoring and control unit 120 monitors the sensors 208, 210, 212 and controls the operation of the pumping system 104. In yet other embodiments, the motor 200, the transmission 202, and/or the pump 204 may be connected to either or both of the control system 206 and the monitoring and control unit 120, and either one of the monitoring and control unit 120 and the control system 206 may monitor the sensors 208, 210, 212 or control the operation of the pumping system 104.

In addition to monitoring the sensors 208, 210, 212 and controlling the operation of the pumping system 104, the control system 206 stores predetermined parameters for each operational state of the pumping system 104. As a non-limiting example, the control system 206 may store information parameters related to which transmission solenoids should be used to activate the clutch for a particular gear selection, what fluid flowrate should be produced by the pump 204 for a certain input torque and rotational speed, and what the acceptable temperature range is for each piece of equipment 200, 202, 204 while performing a particular operation, such as fluid injection, fracturing, and cementing, and other operations involving a pumping system 104.

The control system 206 monitors the information received from the sensors 208, 210, 212 to determine if the pumping system is operating outside of the predetermined parameters for the current operational state of the pumping system 104. If the control system 206 determines that the pumping system 104 is operating outside of the predetermined parameters, the readings from the sensors 208, 210, 212 are evaluated by the control system 206 to determine which component or components of the motor 200, the transmission 202, or the pump 204 is the most likely cause of the pumping system 104 operating outside of the predetermined parameters. This is done by referencing a database stored on the control system 206 that contains expected sensor readings for the pumping system 104 when a particular component has failed. Once the most likely component to have failed is determined, the control system 206 automatically adjusts the pumping system 104 to account for the failed component while still allowing the pumping system 104 to continue operation, which may include operating the pumping system 104 at a reduced performance level.

Figure 3:
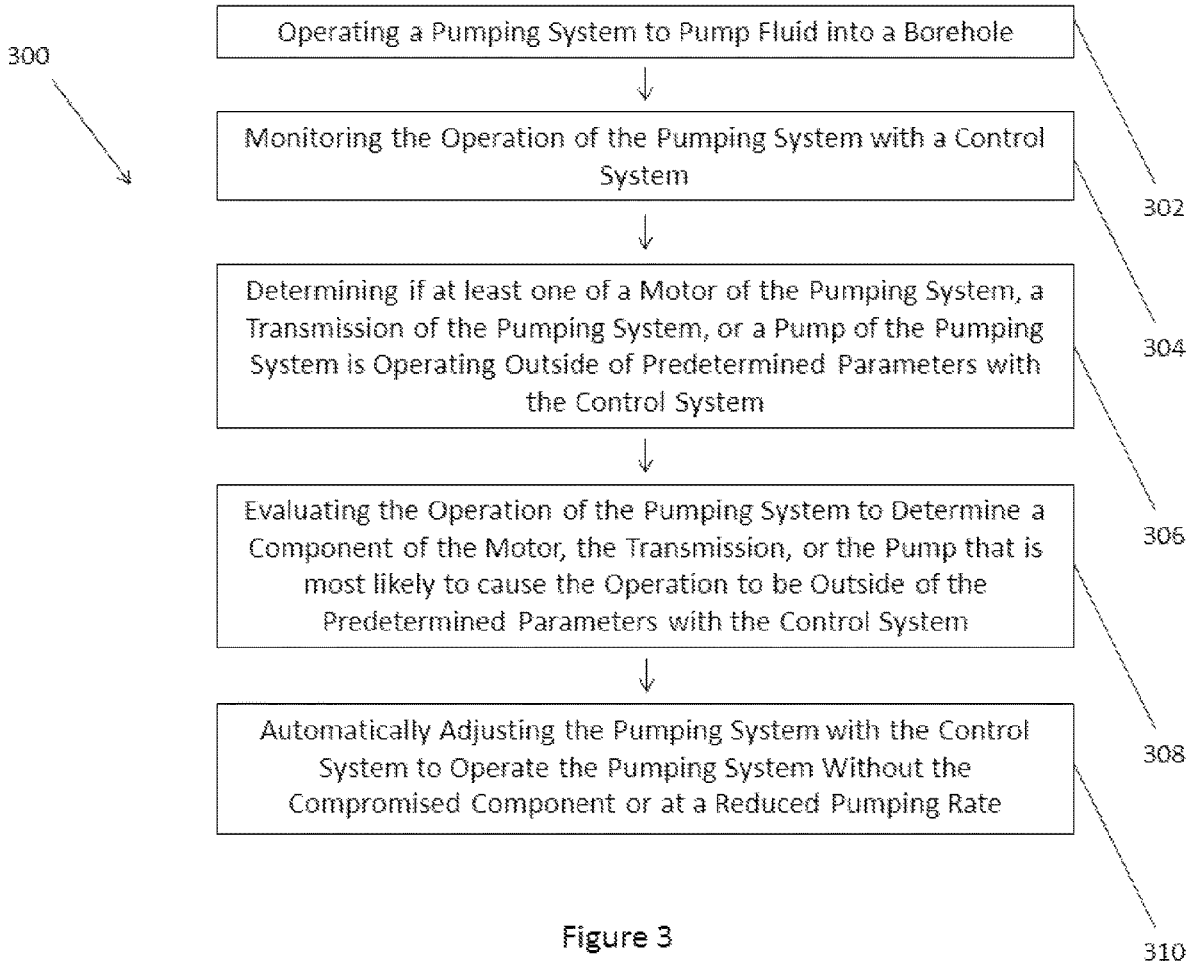
FIG. 3 is a flow chart illustrating a method of controlling a pumping system, according to one or more embodiments.

As an example, FIG. 3 is a flow chart 300 illustrating a method of controlling a pumping system 104 for a borehole fracturing operation. A typical borehole fracturing operation uses the pumping system 104 to pump an isolation plug on a tool string downhole until the isolation plug reaches the target location. Once the isolation plug reaches the target location, a setting tool on the tool string sets the isolation plug within the wellbore. The pumping system 104 then pumps a sealing ball downhole to seat against the isolation plug, isolating the portion of the borehole below the isolation plug. After the lower portion of the borehole is isolated, a perforating gun is run downhole to pierce the casing and fracturing fluid is pumped through the casing and into the oil and gas formation.

As the fracturing operation is occurring, the pumping system 104 is in operation multiple times to pump a fluid into the borehole, as shown at 302. The control system 206 monitors the operation of the pumping system 104, as shown at 304. The control system 206 determines if at least one of the motor 200, the transmission 202, or the pump 204 is operating outside of predetermined parameters for the operation that are stored on the control system 206, as shown at 306. If the control system 206 determines that one or more of these elements are operating outside of the predetermined parameters, the control system 206 evaluates the operation of the pumping system 104 to determine which component or components of the motor 200, the transmission 202, or the pump 204 is the most likely cause of the pumping system 104 operating outside of the predetermined parameters, as shown at 308. The control system 206 then automatically adjusts the pumping system 104 to operating the pumping system 104 without the compromised component or at a reduced pumping rate, as shown at 310.

A possible component failure that can occur during the fracturing operation may include the transmission 202 failing to operate in a specific gear due to slipping or a failed component, such as a solenoid or clutch. To address this issue, the control system 206 may shift the transmission 202 to a new gear that does not use the failed solenoid or clutch and the motor speed and/or torque may be adjusted for use with the new gear, allowing operations to continue. Another possible failure includes a temperature of the motor 200, transmission 202, or pump 204 being too high. In this situation, the control system 206 may reduce the speed and/or torque produced by the motor 200, subsequently reducing the speed of the transmission 202 and the pump 204 and lowering the flowrate of the pump. Such an adjustment will reduce the temperatures on each piece of equipment 200, 202, 204, allowing operation of the pumping system 104 to continue. Another possible issue that may arise is a resonance in the motor 200, the transmission 202, or the pump 204. The pulsations from the engine 200 or pump 204, or torsional resonance from the transmission 202 may cause a beat frequency and/or resonant frequency, in the pumping system 104, increasing vibration within the pumping system 104. These vibrations can cause the pumping system 104 to operate outside of the predetermined parameters and reduce the fatigue life of the components within the pumping system 104. Once vibration due to resonance is detected by the sensors 208, 210, 212, the control system 206 may increase or decrease the speed and/or torque produced by the motor 200 as necessary to shift the pumping system 104 away from the beat frequency.

It should be recognized that the previous list of possible component failures and situations that cause the pumping system 104 to operate outside of predetermined parameters is not exhaustive. The control system 206 may recognize other sources causing the pumping system 104 to operate outside of the predetermined parameters and implement other mitigations to allow the pumping system 104 to continue operation.

Figure 4:
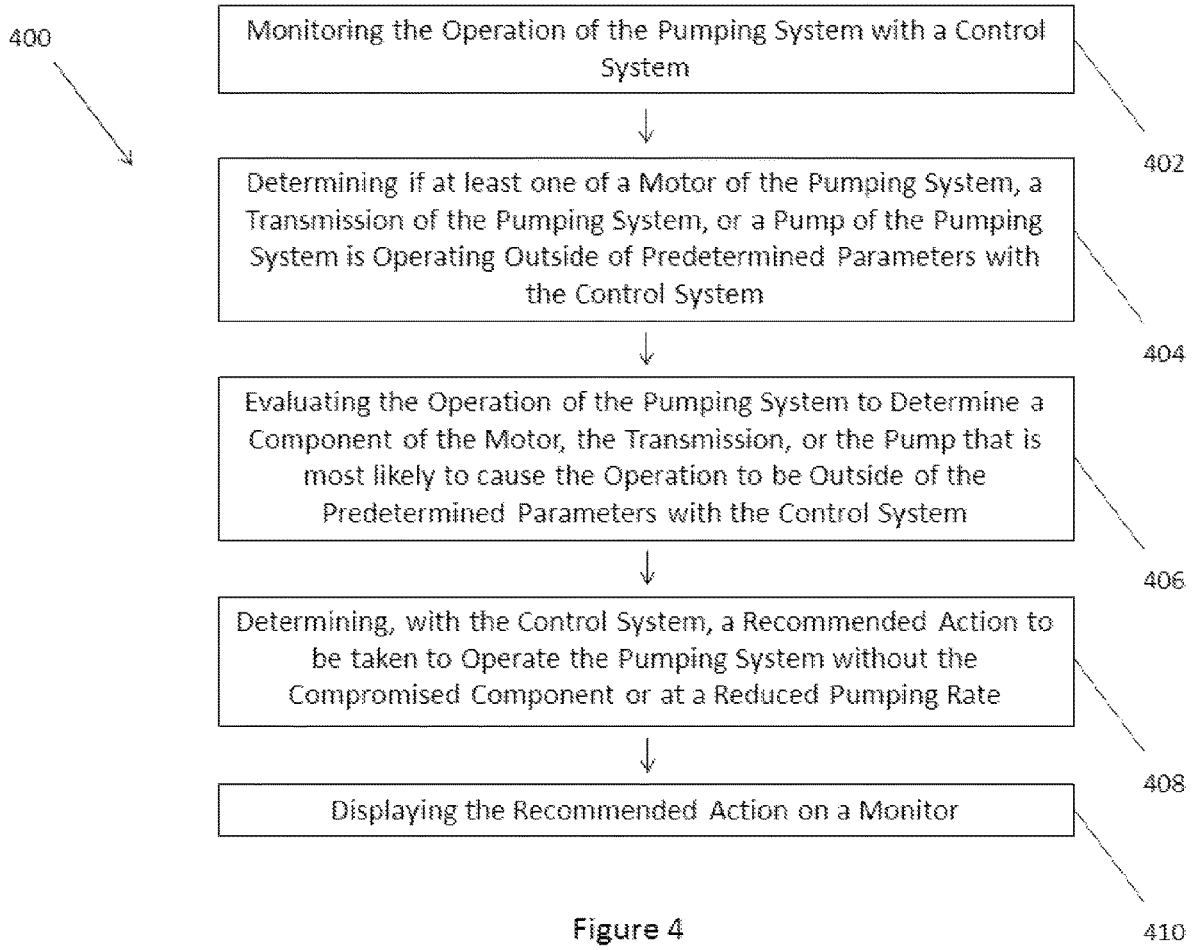
FIG. 4 is a flow chart illustrating a method of controlling a pumping system, according to one or more embodiments.

In other embodiments, the control system 206 may not automatically adjust the pumping system 104. In such situations, the control system 206 may operate according to the method shown in the flow chart 400 of FIG. 4. Similar to the method of FIG. 3, the control system 206 monitors the operation of the pumping system 104, determines if at least one of the motor 200, the transmission 202, or the pump 204 is operating outside of predetermined parameters, and evaluates the operation of the pumping system 104 to determine a component of the motor 200, the transmission 202, or the pump 204 that is the most likely cause of the operation to be outside of the predetermined parameters, as shown at 402, 404, and 406, respectively. However, once the compromised component is determined, the control system 206 then determines a recommended action to be taken to operate the pumping system 104 without the compromised component or at a reduced pumping rate, as shown at 408. The recommended action is displayed on a monitor by the control system 206, as shown at 410, for an operator to implement in the pumping system 104 by inputting commands into the control system 206 or manually adjusting the pumping system 104.

Certain embodiments of the disclosed invention may include a pumping system for performing a borehole operation including pumping a fluid into a borehole. The system may include a motor, a transmission, a pump, and a control system. The motor may include sensors configured to monitor at least one of a temperature of the motor or a rotational speed of the motor. The transmission may be operatively coupled to the motor and include sensors configured to monitor at least one of a temperature of the transmission or a rotational speed of the transmission. The pump may be operatively coupled to the transmission and configured to pump fluid into the borehole. The pump may include pump sensors configured to monitor at least one of a temperature of the pump or a rotational speed of the pump. The control system may be in communication with the motor sensors, the transmission sensors, and the pump sensors. The control system may be configured to monitor the operation of the motor, the transmission, and the pump, determine if at least one of the motor, the transmission, or the pump is operating outside of predetermined parameters, and determine at least one component of the motor, the transmission, or the pump that is most likely to cause the operation to be outside of the predetermined parameters.

In certain embodiments of the pumping system, the control system may be further configured to automatically adjust at least one of the motor, the transmission, or the pump to operate without the compromised component or at a reduced pumping rate.

In certain embodiments of the pumping system, the control system may include a monitor and the control system is configured to display, on the monitor, a recommended action to operate the pumping system without the compromised component or at a reduced pumping rate.

In certain embodiments of the pumping system, the motor sensors may be further configured to monitor at least one of a torque produced by the motor, a filter status of the motor, fluid levels within the motor, or conditions of cylinders of the motor.

In certain embodiments of the pumping system, the transmission sensors may be further configured to monitor at least one of a torque transferred to the transmission from the motor, fluid levels within the transmission, the current gear of the transmission being utilized, transmission slippage, or transmission sticking.

In certain embodiments of the pumping system, the pump sensors may be further configured to monitor at least one of a torque transferred to the pump from the transmission, a suction pressure of the pump, a discharge pressure of the pump, vibration of the pump, fluid flow out of the pump, surface strain on the pump, or a position of plungers within respective cylinders of the pump.

In certain embodiments of the pumping system, the pumping system is part of a wellsite system.

Certain embodiments of the disclosed invention may include a method for performing a borehole operation. The method may include operating a pumping system to pump a fluid into the borehole. The method may also include monitoring the operation of the pumping system with a control system. The method may further include determining, with the control system, if at least one of a motor of the pumping system, a transmission of the pumping system, or a pump of the pumping system is operating outside of predetermined parameters. The method may also include evaluating, with the control system, the operation of the pumping system to determine at least one component of the motor, the transmission, or the pump that is most likely to cause the operation to be outside of the predetermined parameters. The method may further include automatically adjusting at least one of the motor, the transmission, or the pump with the control system to operate the pumping system without the compromised component or at a reduced pumping rate.

In certain embodiments of the method, the method may also include monitoring the pumping system for at least one of a beat frequency or a resonant frequency.

In certain embodiments of the method, the method may also include automatically adjusting the operation of the pumping system to reduce or eliminate vibration associated with the beat frequency or the resonant frequency.

In certain embodiments of the method, monitoring the operation of the pumping system with the control system may include monitoring at least one of a torque produced by the motor, a rotational speed of the motor, a filter status of the motor, fluid levels within the motor, a temperature of the motor, or conditions of cylinders of the motor.

In certain embodiments of the method, monitoring the operation of the pumping system with the control system may include monitoring at least one of a torque transferred to the to the transmission from the motor, a rotational speed of the transmission, fluid levels within the transmission, a temperature of the transmission, the current gear of the transmission being utilized, transmission slippage, or transmission sticking.

In certain embodiments of the method, monitoring the operation of the pumping system with the control system may include monitoring at least one of a torque transferred to the pump from the transmission, a suction pressure of the pump, a discharge pressure of the pump, a rotational speed of the pump, vibration of the pump, a temperature of the pump, fluid flow out of the pump, surface strain on the pump, or a position of plungers within respective cylinders of the pump.

Certain embodiments of the disclosed invention may include a method for performing a borehole operation at a wellsite. The method may include monitoring the operation of a pumping system with a control system. The method may also include determining, with the control system, if at least one of a motor of the pumping system, a transmission of the pumping system, or a pump of the pumping system is operating outside of predetermined parameters. The method may further include evaluating, with the control system, the operation of the pumping system to determine at least one component of the motor, the transmission, or the pump that is most likely to cause the operation to be outside of the predetermined parameters. The method may also include determining, with the control system, a recommended action to be taken to operate the pumping system without the compromised component or at a reduced pumping rate. The method may further include displaying the recommended action on a monitor.

In certain embodiments of the method, the method may also include manually adjusting or automatically adjusting at least one of the motor, the transmission, or the pump based on the displayed recommended action.

In certain embodiments of the method, the method may also include monitoring the pumping system for at least one of a beat frequency or a resonant frequency. The method may further include determining, with the control system, a second recommended course of action to be taken to reduce or eliminate vibration associated with the beat frequency or the resonant frequency. The method may also include displaying the second recommended action on the monitor.

In certain embodiments of the method, the method may also include manually adjusting or automatically adjusting the pumping system based on the displayed second recommendation.

In certain embodiments of the method, monitoring the operation of the pumping system with the control system may include monitoring at least one of a torque produced by the motor, a rotational speed of the motor, a filter status of the motor, fluid levels within the motor, a temperature of the motor, or conditions of cylinders of the motor.

In certain embodiments of the method, monitoring the operation of the pumping system with the control system may include monitoring at least one of a torque transferred to the to the transmission from the motor, a rotational speed of the transmission, fluid levels within the transmission, a temperature of the transmission, the current gear of the transmission being utilized, transmission slippage, or transmission sticking.

In certain embodiments of the method, monitoring the operation of the pumping system with the control system may include monitoring at least one of a torque transferred to the pump from the transmission, a suction pressure of the pump, a discharge pressure of the pump, a rotational speed of the pump, vibration of the pump, a temperature of the pump, fluid flow out of the pump, surface strain on the pump, or a position of plungers within respective cylinders of the pump One or more specific embodiments of the pumping system for a wellsite have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A pumping system for performing a surface operation at a wellsite including pumping a fluid into a borehole, comprising:

a motor comprising motor sensors configured to monitor at least one of a temperature of the motor or a rotational speed of the motor;

a transmission operatively coupled to the motor, the transmission comprising transmission sensors configured to monitor at least one of a temperature of the transmission or a rotational speed of the transmission;

a pump operatively coupled to the transmission and comprising pump sensors configured to monitor at least one of a temperature of the pump or a rotational speed of the pump, the pump configured to pump the fluid into the borehole; and a control system in communication with the motor sensors, the transmission sensors, and the pump sensors, the control system configured to:

monitor operation of the motor, the transmission, and the pump;

determine if the operation of at least one of the motor, the transmission, or the pump is outside of predetermined parameters stored in a database;

determine at least one component of the motor, the transmission, or the pump that is most likely a cause of the operation to be outside of the predetermined parameters stored in the database, wherein the at least one component is a compromised component; and automatically adjust the operation of at least one of the motor, the transmission, or the pump based on the determinations to operate the pumping system without the compromised component or at a reduced rate.

2. The pumping system of claim 1, wherein the control system includes a monitor and the control system is configured to display, on the monitor, a recommended action to operate the pumping system without the compromised component or at a reduced pumping rate.

3. The pumping system of claim 1, wherein the motor sensors are further configured to monitor at least one of a torque produced by the motor, a filter status of the motor, fluid levels within the motor, or conditions of cylinders of the motor.

4. The pumping system of claim 1, wherein the transmission sensors are further configured to monitor at least one of a torque transferred to the transmission from the motor, fluid levels within the transmission, a current gear of the transmission being utilized, transmission slippage, or transmission sticking.

5. The pumping system of claim 1, wherein the pump sensors are further configured to monitor at least one of a torque transferred to the pump from the transmission, a suction pressure of the pump, a discharge pressure of the pump, vibration of the pump, fluid flow out of the pump, surface strain on the pump, or a position of plungers within respective cylinders of the pump.

6. The pumping system of claim 1, wherein the pumping system is part of a wellsite system.

7. A method for performing a surface operation at a wellsite, the method comprising:

operating a pumping system comprising a motor, a transmission, and a pump to pump a fluid into a borehole;

monitoring operation of the pumping system with a control system;

determining, with the control system, if at least one of the motor, the transmission, or the pump is operating outside of predetermined parameters stored in a database;

evaluating, with the control system, the operation of the pumping system to determine at least one component of the motor, the transmission, or the pump that is most likely a cause of the at least one of the motor, the transmission, or the pump to be operating outside of the predetermined parameters stored in the database, wherein the at least one component is a compromised component; and automatically adjusting operation of at least one of the motor, the transmission, or the pump with the control system based on the evaluation to operate the pumping system without the compromised component or at a reduced pumping rate.

8. The method of claim 7, further comprising monitoring the pumping system for at least one of a beat frequency or a resonant frequency.

9. The method of claim 8, further comprising automatically adjusting the operation of the pumping system to reduce or eliminate vibration associated with the beat frequency or the resonant frequency.

10. The method of claim 7, wherein monitoring the operation of the pumping system with the control system comprises monitoring at least one of a torque produced by the motor, a rotational speed of the motor, a filter status of the motor, fluid levels within the motor, a temperature of the motor, or conditions of cylinders of the motor.

11. The method of claim 7, wherein monitoring the operation of the pumping system with the control system comprises monitoring at least one of a torque transferred to the to the transmission from the motor, a rotational speed of the transmission, fluid levels within the transmission, a temperature of the transmission, a current gear of the transmission being utilized, transmission slippage, or transmission sticking.

12. The method of claim 7, wherein monitoring the operation of the pumping system with the control system comprises monitoring at least one of a torque transferred to the pump from the transmission, a suction pressure of the pump, a discharge pressure of the pump, a rotational speed of the pump, vibration of the pump, a temperature of the pump, fluid flow out of the pump, surface strain on the pump, or a position of plungers within respective cylinders of the pump.

13. A method for performing a surface operation at a wellsite, the method comprising:

monitoring operation of a pumping system comprising a motor, a transmission, and a pump with a control system;

determining, with the control system, if at least one of the motor, the transmission, or the pump is operating outside of predetermined parameters stored in a database;

evaluating, with the control system, the operation of the pumping system to determine at least one component of the motor, the transmission, or the pump that is most likely a cause of the at least one of the motor, the transmission, or the pump to be operating outside of the predetermined parameters stored in the database, wherein the at least one component is a compromised component;

determining, with the control system, a recommended action to be taken to operate the pumping system without the compromised component or at a reduced pumping rate; and manually adjusting or automatically adjusting operation of at least one of the motor, the transmission, or the pump based on the recommended action.

14. The method of claim 13, further comprising:

displaying the recommended action on a monitor;

monitoring the pumping system for at least one of a beat frequency or a resonant frequency;

determining, with the control system, a second recommended course of action to be taken to reduce or eliminate vibration associated with the beat frequency or the resonant frequency; and displaying the second recommended action on the monitor.

15. The method of claim 14, further comprising manually adjusting or automatically adjusting the pumping system based on the displayed second recommendation.

16. The method of claim 13, wherein monitoring the operation of the pumping system with the control system comprises monitoring at least one of a torque produced by the motor, a rotational speed of the motor, a filter status of the motor, fluid levels within the motor, a temperature of the motor, or conditions of cylinders of the motor.

17. The method of claim 13, wherein monitoring the operation of the pumping system with the control system comprises monitoring at least one of a torque transferred to the transmission from the motor, a rotational speed of the transmission, fluid levels within the transmission, a temperature of the transmission, a current gear of the transmission being utilized, transmission slippage, or transmission sticking.

18. The method of claim 17, wherein monitoring the operation of the pumping system with the control system comprises monitoring at least one of a torque transferred to the pump from the transmission, a suction pressure of the pump, a discharge pressure of the pump, a rotational speed of the pump, vibration of the pump, a temperature of the pump, fluid flow out of the pump, surface strain on the pump, or a position of plungers within respective cylinders of the pump.

* * * * *